US007198681B2

(12) United States Patent
Nguyen et al.

(10) Patent No.: US 7,198,681 B2
(45) Date of Patent: Apr. 3, 2007

(54) METHODS AND COMPOSITIONS FOR REMOVING RESIN COATINGS

(75) Inventors: Philip D. Nguyen, Duncan, OK (US); Jimmie D. Weaver, Duncan, OK (US); Johnny A. Barton, Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 190 days.

(21) Appl. No.: 10/692,400

(22) Filed: Oct. 23, 2003

(65) Prior Publication Data

US 2005/0090415 A1 Apr. 28, 2005

(51) Int. Cl.
*C11D 7/50* (2006.01)

(52) U.S. Cl. ..... 134/38; 510/201

(58) Field of Classification Search ..... None
See application file for complete search history.

(56) References Cited

U.S. PATENT DOCUMENTS 4,608,086 A * 8/1986 Dodge ..... 106/12
5,529,887 A * 6/1996 Horn et al. ..... 430/331
5,750,482 A * 5/1998 Cummings ..... 510/182
5,954,891 A * 9/1999 Kondoh et al. ..... 134/40
5,962,383 A * 10/1999 Doyel et al. ..... 510/164
6,060,439 A * 5/2000 Doyel et al. ..... 510/164
6,130,195 A * 10/2000 Doyel et al. ..... 510/365
6,197,124 B1 * 3/2001 Nakayama ..... 134/38

* cited by examiner

*Primary Examiner*—Gregory Webb
(74) *Attorney, Agent, or Firm*—Robert A. Kent; Baker Botts

(57) ABSTRACT

The present invention relates to methods and compositions for removing resin coatings. More particularly, the present invention relates to methods and compositions for removing coatings comprising epoxy and/or furan. Some embodiments of the methods of the present invention comprise removing a resin coating from a surface comprising the step of applying to the surface a cleaning solution comprising: a pH-adjusting agent, a solvent, and water. Other embodiments of the present invention comprise cleaning solutions comprising a pH-adjusting agent, a solvent, and water wherein the cleaning solution is suitable for use in cleaning a resin from a surface.

7 Claims, No Drawings

METHODS AND COMPOSITIONS FOR REMOVING RESIN COATINGS

BACKGROUND OF THE INVENTION

The present invention relates to methods and compositions for removing resin coatings. More particularly, the present invention relates to methods and compositions for removing coatings comprising epoxy and/or furan.

Resins are widely used in commercial applications such as, for example, adhesives, sealants or protective layers, etc. Resins are commonly used in subterranean applications to impart consolidation to otherwise mobile particulates in the subterranean formation. For example, resins may be coated onto proppant or gravel material before the material is placed down hole so as to create a consolidated proppant or gravel pack. Also, dilute, low-viscosity resins may be applied directly to formation sands in a subterranean formation to consolidate the formation itself. Among other benefits, such consolidation aids in hindering the migration of particulates within a subterranean formation which may be useful to prevent loose or weakly consolidated particulates in the formation from migrating out with produced fluids where they may abrade and damage pumps, piping, and other associated equipment.

One disadvantage associated with using such resins is the removal and clean up of the resin from equipment used in placing the resin. For example, a residue of resin may remain in fracturing equipment used during fracturing operations, e.g., connecting hoses, valves, sand hoppers, sand screws, blender tubs, etc. Without proper cleaning or removal, there is potential that a layer of resin may build up each time the equipment surface is exposed to the resin. This buildup of resin coat could result in plugging of equipment or causing the equipment not to function properly. Moreover, particulates, such as sand or proppant, may become entrapped within the resin coat and lead to further equipment damage.

SUMMARY OF THE INVENTION

The present invention relates to methods and compositions for removing resin coatings. More particularly, the present invention relates to methods and compositions for removing coatings comprising epoxy and/or furan.

One embodiment of the methods of the present invention comprises the steps of removing a resin coating from a surface by applying to the surface a cleaning solution comprising: a pH-adjusting agent, a solvent, and water.

Another embodiment of the present invention comprises a cleaning solution composition comprising a pH-adjusting agent, a solvent, and water wherein the cleaning solution is suitable for use in cleaning a resin from a surface.

Other and further features and advantages of the present invention will be readily apparent to those skilled in the art upon a reading of the description of some preferred embodiments which follows.

DESCRIPTION OF THE PREFERRED EMBODIMENTS

The present invention relates to methods and compositions for removing resin coatings. More particularly, the present invention relates to methods and compositions for removing coatings comprising epoxy and/or furan. The compositions and methods of the present invention are capable of effectively clean up resinous residue by not only removing resin from a surface, but also by stopping any further curing of that resin.

Some embodiments of the present invention provide cleaning solutions comprising a pH-adjusting agent, a solvent, and water. The epoxy-based and furan-based resins that the cleaning solutions of the present invention are designed to remove are well known in the art. Exemplary embodiments of such epoxy-based resins commonly used in subterranean applications include, but are not limited to, high-temperature (HT) epoxy-based resins and two-component epoxy resins comprising a hardenable resin component and a hardening agent component. Exemplary embodiments of such furan-based resins commonly used in subterranean applications include, but are not limited to, furfuryl alcohols, mixtures of a furfuryl alcohol and an aldehyde, phenolic-based resins, mixtures of furan resins and phenolic resins, and phenol/phenol formaldehyde/furfuryl alcohol resins.

The pH-adjusting agents suitable for use in the present invention are selected based on the resin to be removed. By way of example, epoxy-based resins cure in alkaline environments. By using an acidic pH-adjusting agent to lower the pH, the cleaning solutions of the present invention are able to more effectively remove epoxy resin. By contrast, furan-based resins cure in acidic environments. By using an alkaline pH-adjusting agent to raise the pH, the cleaning solutions of the present invention are able to more effectively remove furan-based resin.

Acidic pH-adjusting agents suitable for use in the present invention comprise essentially any material that is capable of reducing the pH of the cleaning solution that will not adversely effect the clean up process or the equipment being cleaned. The acidic pH-adjusting agent may generally comprise from about 0.1% to about 50% by volume of the cleaning solution. Acidic pH-adjusting agents suitable for use in the present invention include, but are not limited to, acetic acid, citric acid, fumaric acid, hydrochloric acid, sodium acetate, ammonium diacetate, and combinations thereof.

Alkaline pH-adjusting agents suitable for use in the present invention comprise essentially any material that is capable of increasing the pH of the cleaning solution that will not adversely effect the clean up process or the equipment being cleaned. The alkaline pH-adjusting agent may generally comprise from about 0.1% to about 50% by volume of the cleaning solution. Alkaline pH-adjusting agents suitable for use in the present invention include, but are not limited to, sodium hydroxide, potassium hydroxide, ammonium hydroxide, and combinations thereof.

The cleaning solutions of the present invention further comprise a solvent. Solvents suitable for use in the present invention are those materials that are at least partially miscible both with the resin being cleaned and the selected pH-adjusting agent. The solvent generally comprises from about 5% to about 75% by volume of the cleaning solution. Solvents suitable for use in the present invention include, but are not limited to, glycol ethers such as ethylene glycol monobutyl ether, dipropylene glycol monomethyl ether, diethylene glycol monomethyl ether, and combinations thereof.

The cleaning solutions of the present invention further comprise water. The water generally comprises from about 10 to about 95% by volume of the cleaning solution. The water used in the cleaning solutions of the present invention may be fresh water, salt water (e.g., water containing one or more salts dissolved therein), brine (e.g., saturated salt water), seawater, or combinations thereof. Generally, the water may be from any source provided that it does not contain an excess of compounds that adversely affect other components in the cleaning solution.

In one embodiment of the methods of the present invention, the cleaning solution may be applied to a resin coated onto a surface of equipment or a particulate. The cleaning solution may be applied by, for example, submerging the coated surface or coated particulate into the cleaning solution, spraying the cleaning solution on the coated surface or coated particulate or any other conventional method of applying a solution. Application of the cleaning solution of the present invention not only acts to remove the resin by thinning or dissolving it with the solvent, it also stops the curing process of the resin.

To facilitate a better understanding of the present invention, the following examples of some of the preferred embodiments are given. In no way should such examples be read to limit the scope of the invention.

EXAMPLES

Example 1

In a first example, four uncoated metal plates were weighed and their weight recorded. The metal plates were then dipped into either curable epoxy or furan resins; the excess resin was allowed to run off, leaving behind a residue of resin on the plates; and the resin-coated metal plates were reweighed to determine the degree of coating on the plates. Next the resin-coated plates were placed in an oven at 100° F. for 1 or 2 hours, to encourage the resin to at least partially cure. Then the plates were cooled to room temperature and again weighed.

The epoxy coated plates were then completely submersed and suspended in a solution of about 5% ammonium diacetate (acid pH-adjusting agent), about 25% ethylene glycol monobutyl ether (solvent), and about 70% water and slightly stirred for 5 minutes. The metal plates were removed from the cleaning solution, allowed to dry, and weighed again.

The furan coated plates were completely submersed and suspended in a solution of about 5% sodium hydroxide (alkaline pH-adjusting agent), about 25% ethylene glycol monobutyl ether (solvent), and about 70% water and slightly stirred for 5 minutes. The metal plates were removed from the cleaning solution, allowed to dry, and weighed. Table 1 shows the percent clean up of the resin-coated metal plates, which was determined by how much resin had been removed.

TABLE 1

| Components in cleaning solution | Epoxy coated metal plate for 1 hours at 100° | Epoxy-coated metal plate for 2 hours at 100° | Furan-coated metal plate for 1 hours at 100° | Furan-coated metal plate for 2 hours at 100° |
|---|---|---|---|---|
| | Volume % of components in cleaning solution | | | |
| Ammonium diacetate | 5 | 5 | 0 | 0 |
| Sodium hydroxide | 0 | 0 | 5 | 5 |
| Water | 70 | 70 | 70 | 70 |
| Ethylene glycol monobutyl ether | 25 | 25 | 25 | 25 |
| Percent cleanup | 98 | 97 | 94 | 90 |

Example 2

In a second example, 250 grams of proppant was coated with 7.8 cc of either an epoxy resin or a furan resin. The epoxy coated proppant was sprayed with 20 cc of a cleaning solution comprising about 5% ammonium diacetate (acid pH-adjusting agent), about 25% ethylene glycol monobutyl ether (solvent), and about 70% water, stirred well, packed in a brass chamber and cured in an oven at 325° F. for 24 hours. The furan coated proppant was sprayed with 20 cc of a cleaning solution comprising about 5% sodium hydroxide (alkaline pH-adjusting agent), about 25% ethylene glycol monobutyl ether (solvent), and about 70% water, stirred well, packed in a brass chamber and cured in an oven at 325° F. for 24 hours. Control samples of both epoxy and furan coated proppant were prepared and not sprayed with cleaning solution, but simply packed in brass chamber and cured in oven at 325° F. for 24 hours. After the curing period, the consolidated proppant pack was removed from the brass chamber and the unconfined compressive strength (UCS) was determined for each sample. The results indicated that the resin-coated proppant that had been sprayed and stirred with cleaning solution had no consolidation strength. The resin-coated proppant that was sprayed with cleaning solution remained as individual grains without forming aggregates. In contrast, the control samples of resin coated proppant that were not treated with cleaning solution had transformed into a consolidated mass. The average UCS value of epoxy-coated proppant cores was 870 psi and the average UCS value of furan-coated proppant cores was 660 psi.

Therefore, the present invention is well adapted to carry out the objects and attain the ends and advantages mentioned as well as those that are inherent therein. While numerous changes may be made by those skilled in the art, such changes are encompassed within the spirit and scope of this invention as defined by the appended claims.

What is claimed is:

1. A method of removing a furan-based resin coating from a surface comprising applying a cleaning solution comprising a pH-adjusting agent, a solvent, and water to a surface at least partially coated with a furan-based resin, wherein the solvent is selected from the group consisting of dipropylene glycol monomethyl ether, diethylene glycol monomethyl ether, and combinations thereof.

2. The method of claim 1 wherein the cleaning solution comprises from about 0.1% to about 50% by volume pH-adjusting agent.

3. The method of claim 1 wherein the pH-adjusting agent comprises a base.

4. The method of claim 1 wherein the pH-adjusting agent is selected from the group consisting of sodium hydroxide, potassium hydroxide, ammonium hydroxide, and combinations thereof.

5. The method of claim 1 wherein the cleaning solution comprises from about 5% to about 75% by volume solvent.

6. The method of claim 1 wherein the cleaning solution comprises from about 10% to about 95% by volume water.

7. The method claim 1 wherein the water is selected from the group consisting of fresh water, salt water, brine, seawater, and combinations thereof.

* * * * *